US007997769B2

(12) United States Patent
Foo

(10) Patent No.: US 7,997,769 B2
(45) Date of Patent: Aug. 16, 2011

(54) LED REFLECTOR

(75) Inventor: Onn Fah Foo, Hong Kong (CN)

(73) Assignee: Mass Technology (H,K,) Limited, Hong Kong (CN)

( * ) Notice: Subject to any disclaimer, the term of this patent is extended or adjusted under 35 U.S.C. 154(b) by 272 days.

(21) Appl. No.: 12/455,240

(22) Filed: May 29, 2009

(65) Prior Publication Data

US 2010/0182784 A1 Jul. 22, 2010

(30) Foreign Application Priority Data

Jan. 22, 2009 (CN) ..... 2009 1 0002486

(51) Int. Cl.
*F21V 29/00* (2006.01)

(52) U.S. Cl. ..... 362/294; 362/249.02; 362/345; 362/800

(58) Field of Classification Search ..... 362/218, 362/235, 249.02–249.06, 294, 345, 373, 362/800

See application file for complete search history.

(56) References Cited

U.S. PATENT DOCUMENTS

| | | | | |
|---|---|---|---|---|
| 6,641,284 | B2 * | 11/2003 | Stopa et al. | 362/294 |
| D545,456 | S | 6/2007 | Foo | |
| 7,771,079 | B2 | 8/2010 | Foo | |

FOREIGN PATENT DOCUMENTS

| | | |
|---|---|---|
| AU | 2009201847 | 8/2010 |
| CN | 201152496 | 11/2008 |
| CN | 101655187 | 2/2010 |
| EP | 2211094 | 7/2010 |
| JP | 2010-170977 | 8/2010 |

* cited by examiner

*Primary Examiner* — Stephen F Husar
(74) *Attorney, Agent, or Firm* — Koppel, Patrick, Heybl & Philpott

(57) ABSTRACT

An LED reflector lamp has a control circuit, at least two LED light sources controlled by the control circuit, at least two light source panels coupled to respective at least two LED light sources, and at least one heat-conducting plate thermally connected to the at last two light source panels. The LED lamp reflector has a reflective cup having a reflective inner surface, a reflective opening formed by an edge of the reflective inner surface, and a slot formed on a bottom of the reflective cup, wherein the at least one heat-conductive plate is inserted through the slot into an interior of the reflective cup such that the LED light sources are parallel to a centrally vertical axis of the reflective cup. A heat sink is described that has a cavity in its interior, the cavity being dimensioned and shaped to be coupled to the reflective cup and plate.

22 Claims, 12 Drawing Sheets

(A)

(B)

LED REFLECTOR

This application claims the benefit of Chinese Patent Application No. 200910002486.1 filed Jan. 22, 2009.

FIELD OF THE INVENTION

The present invention is generally in the field of lighting fixtures. More specifically, the present invention concerns a LED reflector lamp used as a lighting fixture with high luminous efficiency and enhanced thermal dissipation characteristics.

BACKGROUND OF THE INVENTION

As a solid state light source, LEDs (light-emitting diodes) emerged in the sixties of the $20^{th}$ century and are a product with long life span, firm structure, low power consumption and flexible dimension such that they are becoming to take the place of conventional high pressure halide lamps in a wide range of lighting applications. However, LEDs would generate comparatively high heat energy, with a result of their high light fades and shortened life span. This leads to limited applications of LEDs to some extent.

A currently available LED lamp, which is used for the purpose of illumination, usually comprises a plurality of LED light sources with a lampshade to reach the required illuminance and power, because a single one LED light source has relatively low illuminance and power. The greater the number of the LED light sources is, the more luminous and efficacious the LED lamp is. FIG. 1 illustrates a LED lamp available in the prior art. The LED lamp of FIG. 1 has a plurality of LED light sources 1 mounted equally and horizontally on a same panel 2, wherein each of the LED light sources is arranged on a same horizontal plane with a lampshade and then assembled with a common lamp holder 3 to form a common PAR lamp found in the market. As shown in FIG. 2, this PAR lamp may satisfy the requirement for illuminance, but it does not have specialized means for heat conduction and heat dissipation. As a consequence, the heat energy generated by the plurality of LED light sources cannot be effectively dissipated, such that the temperature of the housing of the lamp is so high to the extent that people would get scalded and that this lamp is vulnerable to get burned out. Moreover, because of the absence of light-condensing elements, the light emitting from the LED light sources cannot be condensed effectively, with the result of light loss and low light availability.

Chinese Utility Model No. 200820101329.7 with the title "LED Light Fixture" discloses a LED road lamp which has a plurality of light units each consisting of a LED light source and a light cover mounted on a horizontal panel relative to a centrally vertical axis of the housing of the lamp, wherein each of the LED light sources is arranged on a same horizontal plane. The lamp of this Chinese utility model made an improvement in thermal dissipation, but it is designed such that all the LED light sources are facing outward. Therefore, most of the luminous flux emitting from the LEDs directly project onto a supposed working surface to generate glare and dazzle and affect people's eyes. Also, this lamp is unable to condense the light and its light efficacy is affected. Because all of the LEDs are arranged horizontally on the same plane, the lamp is definitely large in size if it is made to have a higher power.

According to the LED lamps in the prior art, there is about 90% to 100% of their luminous flux that project onto supposed working surfaces, which leads to the problems of thermal dissipation and short life span. The projection angles of these LED lamps are fixed and cannot be adjusted or changed according to the needs in the practice, which inevitably results in limited applications of these LED lamps. As mentioned above, the output of lights is dazzling and can do harm to people's eyes if the eyes come in direct contact with the lights. Moreover, there is no condensation of lights emitting from these LED lamps, and so their luminous efficiency are comparatively low.

Therefore, there is a need for improving the currently available LED lamps used for the purpose of illumination in terms of their thermal dissipation and light condensation. If the thermal dissipation is enhanced, a high power LED lamp can be made small in size and the luminous efficiency can be increased. If the projection angle are adjustable and the lights can be condensed, the problem of generating glare and dazzling would be avoided with enhanced luminous efficiency and increased luminous flux.

SUMMARY OF THE INVENTION

An object of the invention is to address the drawbacks in the prior art mentioned above by providing a novel LED reflector lamp which has good characteristics of thermal conduction, thermal dissipation and light condensation. The LED reflector lamp can also have an adjustable projection angle that structurally solve the problem of glare and produce non-dazzling output of lights.

The above object can be attained by providing a LED reflector lamp comprising a control circuit, the LED reflector further comprises:

at least two LED light sources which are controlled by the control circuit;

at least two light source panels on which the at least two LED light sources are secured, respectively;

at least one heat-conducting plate on which the at least two light source panels are secured in a thermally conductive manner;

a reflective cup having a reflective inner surface, a reflective opening formed by a edge of the reflective inner surface, and a slot formed on a bottom of the reflective cup, wherein the heat-conducting plate secured with the LED light sources and the light source panels are inserted through the slot into an interior of the reflective cup such that the LED light sources are parallel to a centrally vertical axis of the reflective cup; and a heat sink having a cavity in its interior, the cavity being dimensioned and shaped to be coupled to at least a part of the reflective cup and the heat-conducting plate.

In one preferred embodiment of the invention, the LED reflector lamp comprises:

two LED light sources;

two light source panels on which the two LED light sources are secured, respectively; and one heat-conducting plate, on each side of which the two light source panels are secured, respectively;

wherein the heat sink is of annular configuration and has a reflective inner surface that lies tightly against an outer surface of the reflective cup.

Preferably, the reflective cup consists of two symmetrical halves which are disposed symmetrically relative to the centrally vertical axis, each of the two halves has a reflective inner parabolic surface formed by extension of parabolas, wherein centers of the LED light sources are located at foci of the inner parabolic surfaces, respectively. Such a configuration makes it possible that all the lights emitting from the LEDs are reflected by the inner parabolic surfaces of the two symmetrical halves to give out a better light condensation, thereby the LED reflector lamp has a higher luminous flux.

It is found that the luminous flux can be increased by about 5% to 20% if the LED light sources are arranged to overlap the focus of the parabolas of the inner parabolic surfaces of the reflective cup.

The LED reflector lamp can further comprise a metal cap disposed at the centrally vertical axis of the reflective cup, and the metal cap has two opposite sides, on each of the two sides is formed a notch of same thickness of the heat-conducting plate, and the heat-conducting plate is snapped into the notches.

According to the invention, the LED light sources are secured on the light source panels by glue dispensing or mechanically, the light source panels are secured to the heat-conducting plate by fasteners, glue dispensing or viscous radiating oils. Advantageously, a layer of radiating oil is arranged between the light source panels and the heat-conducting plate.

Preferably, the reflective cup is substantially horn-shaped, and the reflective inner surface is coated with light reflecting materials.

The heat sink can be made as a hollow cylinder, and the inner surface is of an arched configuration that mates with an outer surface of the reflective cup such that the inner surface of the heat sink lies tightly against the outer surface of the reflective cup. At its outer surface, the heat sink has a plurality of radiating fins that are parallel to the centrally vertical axis of the reflective cup and disposed in a spaced manner, in order to achieve a better thermal dissipation effect. In addition, the heat sink has at its one end a plurality of ribs that extend from a center of the heat sink to side walls of the heat sink. These ribs can serve as reinforced ribs and facilitate the thermal dissipation.

According to the invention, the LED light sources can be arranged to get close to the bottom of the reflective cup, or get close to the reflective opening of the reflective cup. In this way, the angle of light beams reflected from the reflective cup can be altered, for example, between 10° and 60°, because the lights emitting from the LED light sources are reflected by the inner surface of the reflective cup.

In another preferred embodiment of the invention, the heat-conducting plate is arranged such that a centrally vertical axis of the heat-conducting plate overlaps the centrally vertical axis of the reflective cup, and that a tangent line of a joint defined by the centrally vertical axis of the heat-conducting plate and arc lines of the reflective cup is vertical to the centrally vertical axis of the heat-conducting plate.

The heat-conducting plate, the heat sink and the reflective cup can be made individually, or any two of them can be made integrally, or all of them can be made as one piece.

In order to enhance the thermal dissipation, the light source panels, the heat-conducting plate, the heat sink and the reflective cup are advantageously formed with a thermally conductive material, such as aluminium, aluminium alloy or ceramic.

The LED reflector lamp according to the invention has excellent luminous efficiency and light condensation, and therefore, there is no need for a lampshade for the lamp. Of course, a lampshade can be provided at the opening of the reflective cup if desired.

In the LED reflector lamp of the invention, the LED light source panels tightly come into contact with the heat-conducting plate which is integral with the heat sink to create a good path for thermal conduction and thermal dissipation. This path allows the heat energy generated from the LED light sources to be dissipated successfully through the light source panels—the heat-conducting plate—the heat sink and the reflective cup, and the temperature of the LED light sources is therefore decreased greatly. Due to the lack of the lampshade, the LED light sources can communicate directly with air so as to further facilitate the thermal dissipation of the lamp, which further decreases the heat energy when the LEDs is luminous. The configuration of the LED reflector lamp of the invention ensures that the LED would not be over-heated so as to reach a longer life span of the lamp. The invention has solved the problem of thermal dissipation associated with high power LED lamps, and allows for a plurality of LEDs to be mounted in a compact manner, such that a higher power LED lamp can be made small in size.

The lights emitting from the LEDs are reflected outward by the reflective cup to be condensed efficiently, because the LED light sources are mounted on a center of the reflective cup. Altering the position of the LED light sources is accompanied with the alteration of the angle of the light beams reflected by the reflective cup, which is beneficial to application of the lamp in various occasions.

When the LED light sources are arranged at the positions which correspond to the foci of the parabolas forming the inner parabolic surfaces of the reflective cup, the lights are emitting from the LEDs with a higher luminous flux in a more condensed manner. In this case, the use of a lower power LED reflector lamp can generate the same illuminating effect as a higher power LED lamp in the prior art. This lower power LED reflector lamp has a longer life span due to its lower power and lower heat generation.

The objects, characteristics, advantages and technical effects of the invention will be further elaborated in the following description of the concepts and structures of the invention with reference to the accompanying drawings.

DETAILED DESCRIPTION OF THE INVENTION

Figure 1:
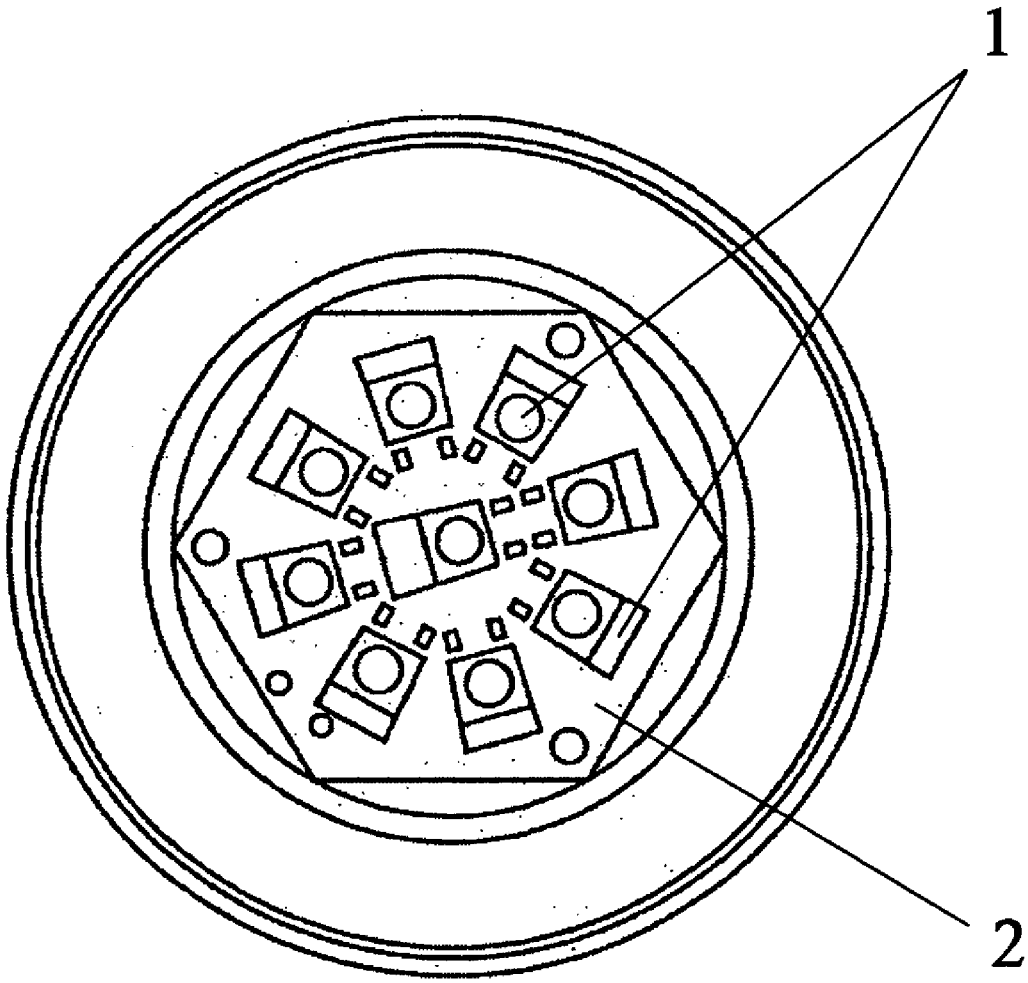
Fig. 1 (Prior Art)
FIG. 1 is a top view of a LED lamp fixture available in the prior art.
Figure 2:
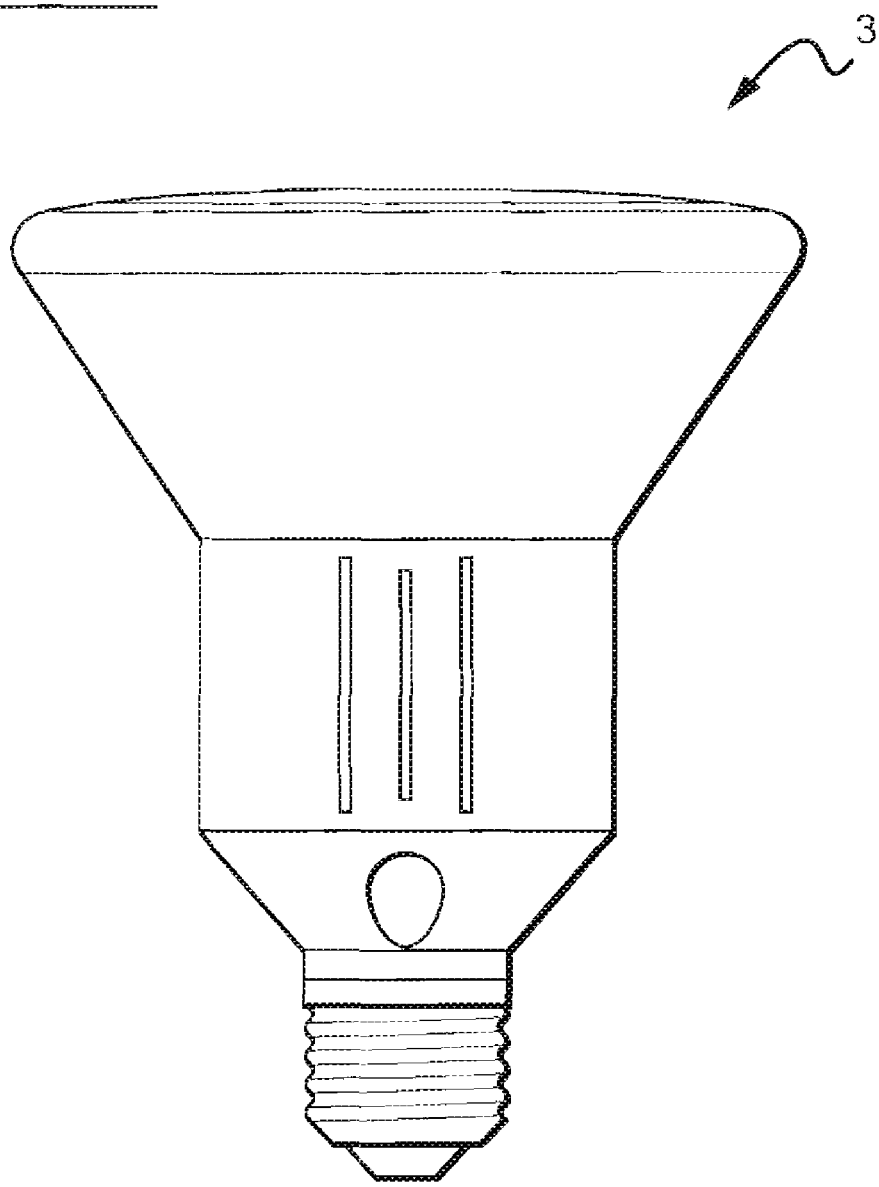
FIG. 2 PRIOR ART
FIG. 2 is a front view of the LED lamp fixture of FIG. 1.
Figure 3:
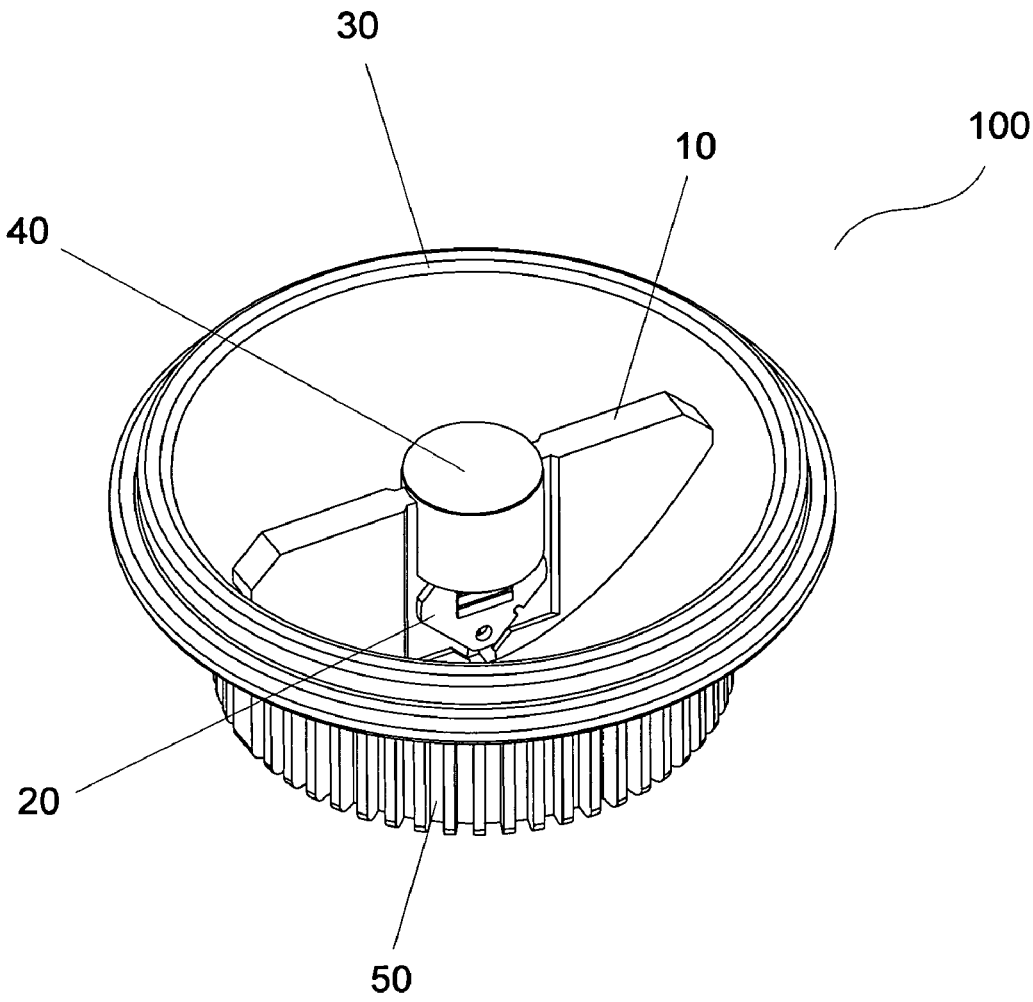
FIG. 3 is a perspective top view of a LED reflector lamp having two light source panels constructed in accordance with a first embodiment of the invention.

While this invention is illustrated and described in preferred embodiments, the LED reflector lamps may be produced in many different configurations, sizes, forms and materials.

Referring now to the drawings, FIGS. 3 to 6 provide a LED reflector lamp 100 constructed consistent with a first preferred embodiment of the present invention. In this embodiment, the LED reflector lamp 100 comprises two LED light sources 60, two light source panels 20, a heat-conducting plate 10, a heat sink 50, a reflective cup 30, a metal cap 40 and a control circuit (not shown) for controlling the LED light sources. The control circuit can be formed integral with the LED reflector lamp and fixed to the radiating fins at the outer surface of the heat sink; or can be formed separately from the LED reflector lamp and have a plug type connector for electrical connection with the LED reflector lamp. The control circuit is not the essence of the invention and therefore not described in detail herein.

The LED light source 60 can consist of one or more LEDs. In this embodiment, each of the two LED light sources 60 consists of 3 chip LEDs which are secured on the respective light source panel 20. The LED light sources 60 can be secured to the light source panels 20 by glue dispensing or mechanically or any means known in the art. Each light source panel 20 has screw holes 22, 24 through which the light source panel 20 is screwed onto the heat-conducting plate 10. A layer of radiating oil may be arranged between the light source panels 20 and the heat-conducting plate 10 to obtain a better thermally conductive effect. Of course, the light source panels 20 can be secured on the heat-conducting plate 10 to create good performances of thermal conduction and thermal dissipation therebetween by use of a technique known in the art. For example, the light source panels 20 can be attached to the heat-conducting plate 10 through a viscous radiating oil.

Figure 5:
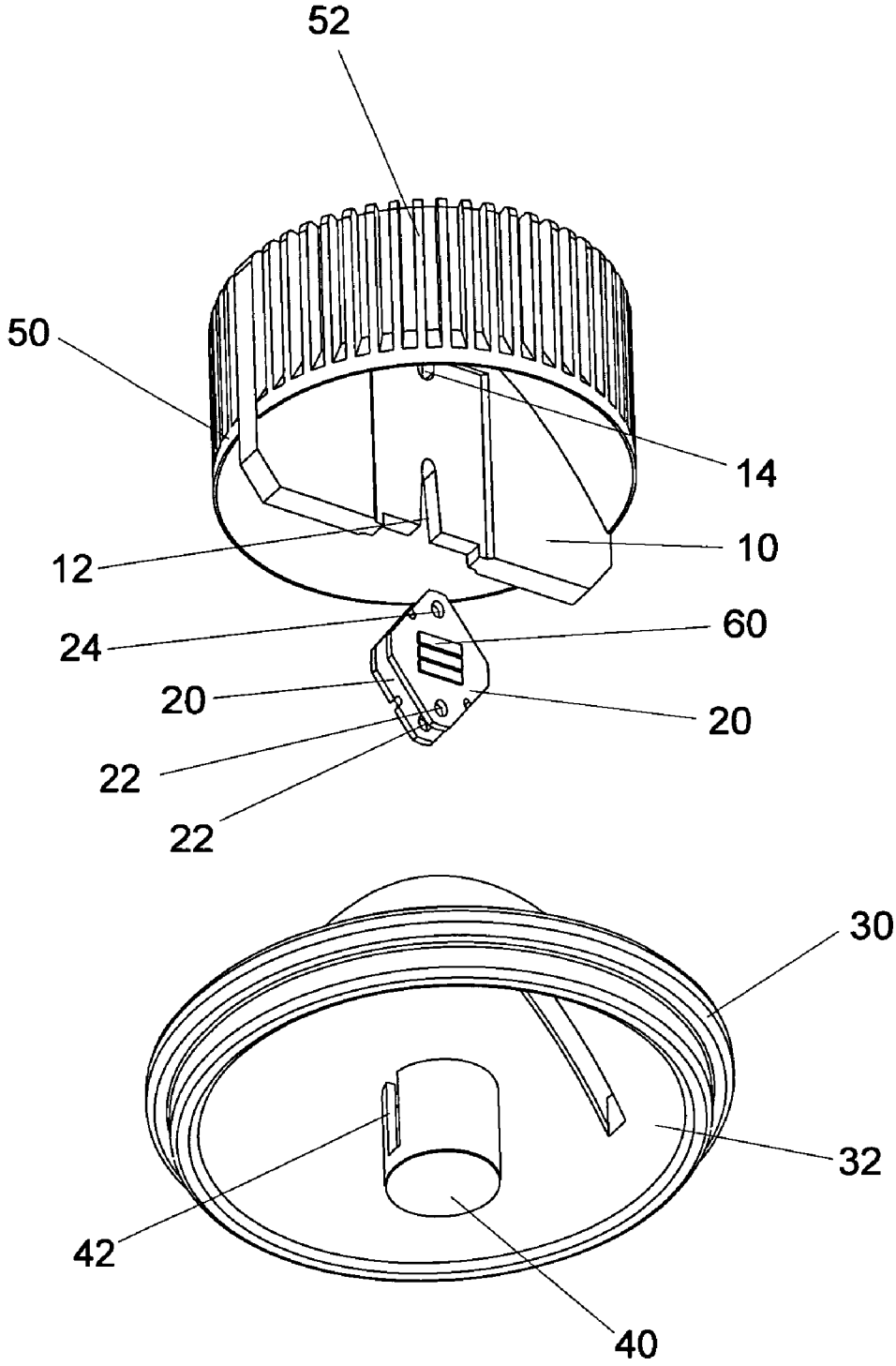
FIG. 5 is a perspective exploded bottom view of the LED reflector of FIG. 3.
Figure 6:
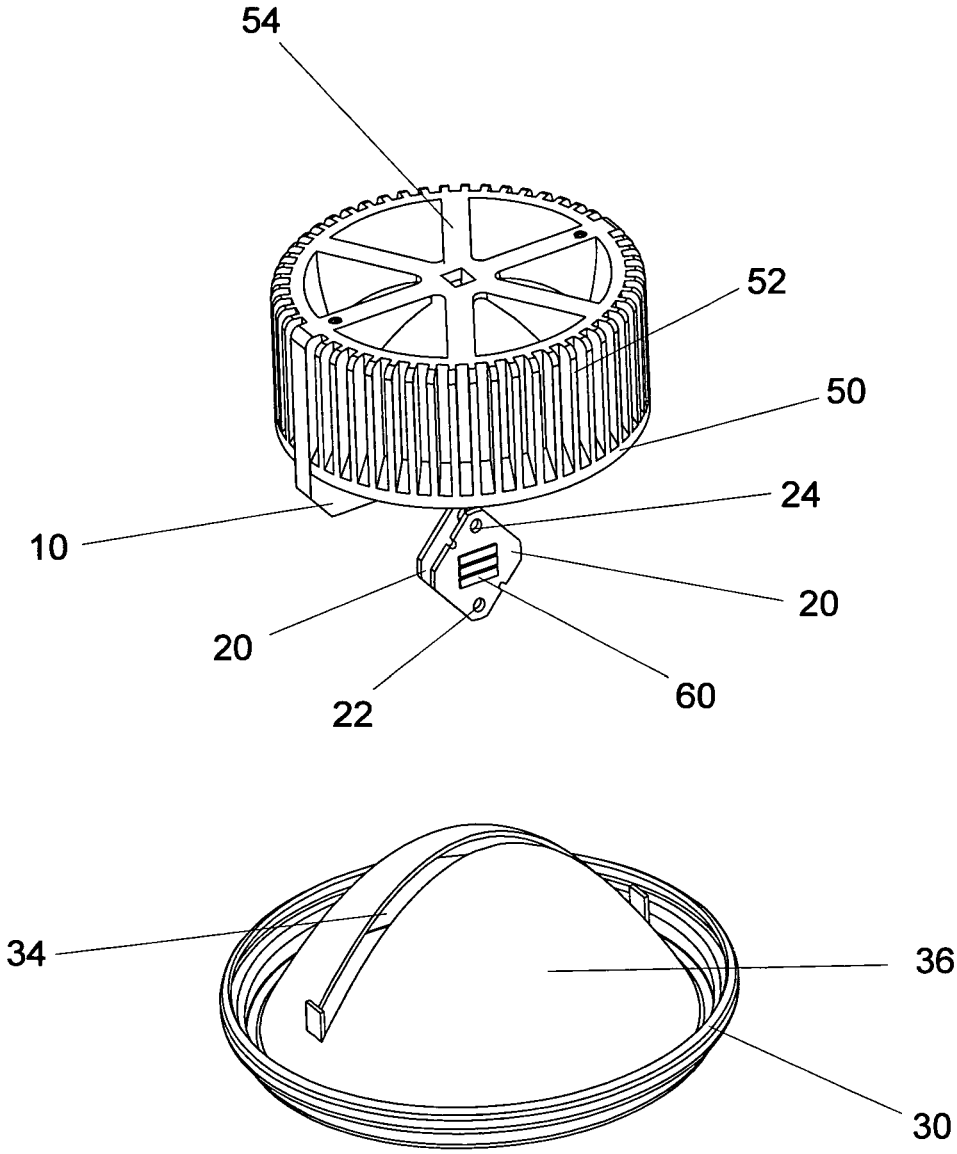
FIG. 6 is a perspective exploded top view of the LED reflector of FIG. 3.

As shown in FIGS. 5 and 6, the heat-conducting plate 10 is a semicircular plate which has a notch 12 and a screw hole 14 at the positions respectively corresponding to the screw holes 22, 24 of the light source panels 20. The two light source panels 20 are respectively locked onto two sides of the heat-conducting plate 10 by putting these light source panels at the respective sides of the heat-conducting plate 10 with the screw holes 22, 24 of the light source panels 20 in alignment with the notch 12 and the screw hole 14 of the heat-conducting plate 10 and then screwing up. As mentioned above, a layer of radiating oil can be coated on a contact surface between the light source panel 20 and the heat-conducting plate 10 before giving a good screw. As an alternative, a viscous radiating oil can be used to directly attach the two light source panels 20 onto the two sides of the heat-conducting plate 10, respectively.

Figure 4:
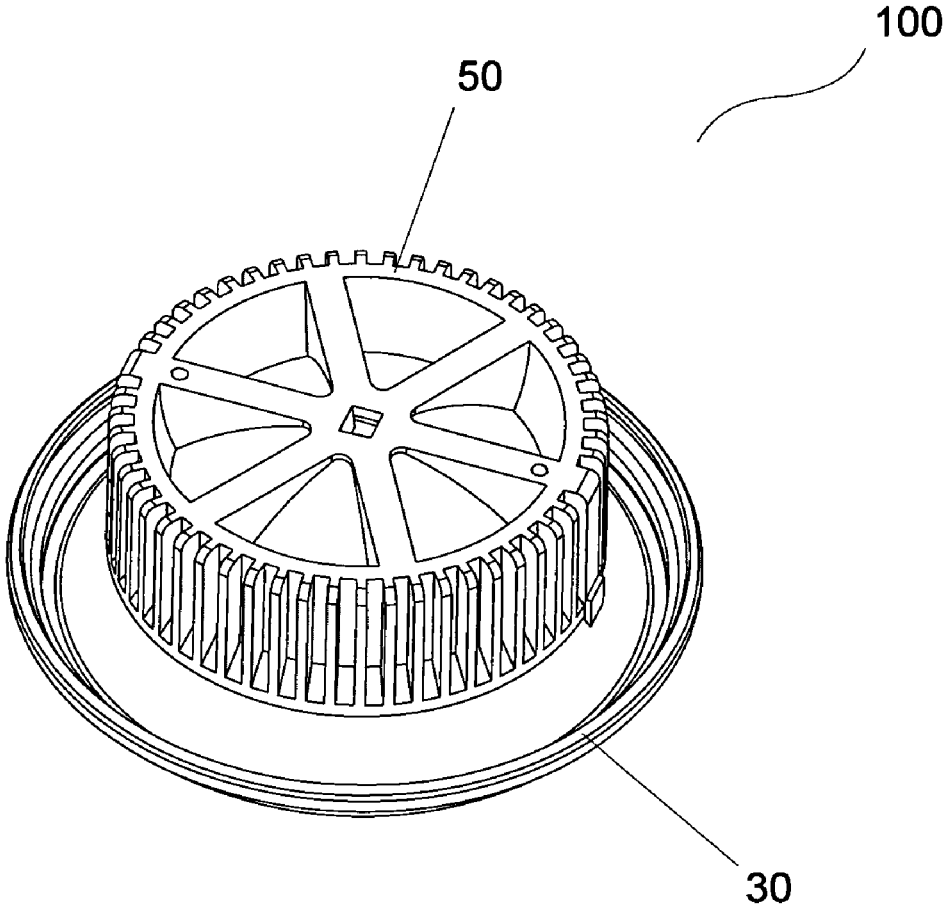
FIG. 4 is a perspective bottom view of the LED reflector of FIG. 3.

The heat sink 50 is of annular configuration, and the heat-conducting plate 10 is disposed in an interior cavity of the heat sink 50 such that the heat-conducting plate 10 overlaps a centrally vertical axis of the heat sink 50. In this embodiment, the heat sink 50 and the heat-conducting plate 10 are formed integrally. Of course, they can be plug-connected together to create a good thermally conductive contact. FIGS. 4 and 6 show that the heat sink 50 has at its outer end a plurality of ribs 54 that extend from a center of the outer end to side walls of the heat sink. These ribs 54 can serve as reinforced ribs and facilitate the thermal dissipation. The heat sink 50 has an inner surface that is of an arched configuration mating with an outer surface 36 of the reflective cup 30 such that the inner surface of the heat sink 50 lies tightly against the outer surface 36 of the reflective cup 30, which facilitates the heat dissipation through the reflective cup 30. In addition, the heat sink 50 has at its outer surface a plurality of radiating fins 52 that are parallel to the centrally vertical axis of the reflective cup and disposed in a spaced manner. The arrangement of the radiating fins 52 further boosts the dissipation of heat energy transmitted from the heat-conducting plate 10.

The reflective cup 30 has a reflective inner surface 32, a reflective opening formed by an edge of the reflective inner surface 32, and a slot 34 formed in a bottom of the reflective cup. The reflective cup 30 is substantially horn-shaped with its bottom portion of small diameter and its opening portion of large diameter to exhibits a PAR lamp characteristic. The horn-shaped configuration allows increased luminous efficiency and enhanced light condensation. The reflective inner surface 32 of the reflective cup 30 is a smooth arc surface that can be coated with light reflecting materials to enhance the luminous efficacy. The lights emitting from the LED light sources 60 would be reflected onto the reflective inner surface 32 of the reflective cup and then would be reflected outward by the reflective opening. In this embodiment, the reflective opening does not have a glass lampshade, allowing the chip LEDs directly communicate with the atmosphere, which is advantageous to the thermal dissipation and consequently to the reduction in the heat generation of the LEDs. A smooth and transparent glass lampshade may be provided on the reflective cup if desirable. The slot 34 is sized and shaped such that the heat-conducting plate 10 secured with the LED light sources 60 and the light source panels 20 are inserted through the slot 34 into the interior of the reflective cup, with the LED light sources 60 being parallel to the centrally vertical axis of the reflective cup 30. Preferably, the heat-conducting plate 10 is arranged such that the centrally vertical axis of the heat-conducting plate 10 overlaps the centrally vertical axis of the reflective cup 30, and a tangent line of a joint defined by the centrally vertical axis of the heat-conducting plate 10 and arc lines of the reflective cup 30 is vertical to the centrally vertical axis of the heat-conducting plate 10. In this case, the three chip LEDs secured on each of the light source panels 20 are all disposed on a same vertical plane, and the lights emitting from the LEDs can evenly be reflected onto the reflective inner surface 32 of the reflective cup, and then reflected outward in a very condensed manner to reach the illumination requirement.

According to the invention, the light sources panels 20 can be arranged such that the LED light sources 60 get close to the slot 34 of the bottom of the reflective cup 30, or such that the LED light sources 60 get close to the reflective opening of the reflective cup 30. As mentioned above, the lights emitting from the chip LEDs are reflected outward through the reflective inner surface 32 of the reflective cup 30, therefore, the alteration of the position of the LED light sources 60 on the reflective cup would allow the alteration of the angle of the light beams reflected outward from the reflective cup, and thus allow the adjustment of the projection angle of the lights of the LED reflector lamp. This is unlike to the prior art LED lamps which adopt a reflective lamp cover to control the angle of light beams. In the LED reflector lamp of the invention, the angle of the light beams can be generally altered between 10° and 60°.

The metal cap 40 is a hollow cylinder which has an opened end, a closed end and two opposite sides each having a notch 42. The notches are sized to mate with the thickness of the heat-conducting plate 10 such that the heat-conducting plate 10 is snapped snugly into the notches 42. The metal cap 40 can get in the lights emitting from the LED light sources right underneath the metal cap 40 and at the center of the reflective cup, therefore, people would not contact directly with the lights emitting directly from the LED light sources, providing the protection for people's eyes from the glare or dazzling. A top face of the closed end of the metal cap 40 can be designed to be green fluorescent in order to identify the LED reflector lamp of the invention.

The heat-conducting plate 10, the heat sink 50 and the reflective cup 30 can be made individually and snap-connected to one another to create good contact in a thermally conductive manner. Any two of them, i.e. the heat-conducting plate 10 and the heat sink 50, or the heat-conducting plate 10 and the reflective cup 30, or the heat sink 50 and the reflective cup 30, can be formed integrally. Also the heat-conducting plate 10, the heat sink 50 and the reflective cup 30 can be made as one piece.

The light source panels 20, the heat-conducting plate 10, the heat sink 50 and the reflective cup 30 are preferably formed with a thermally conductive material selected from the group consisting of aluminium, aluminium alloy and ceramic.

Figure 7:
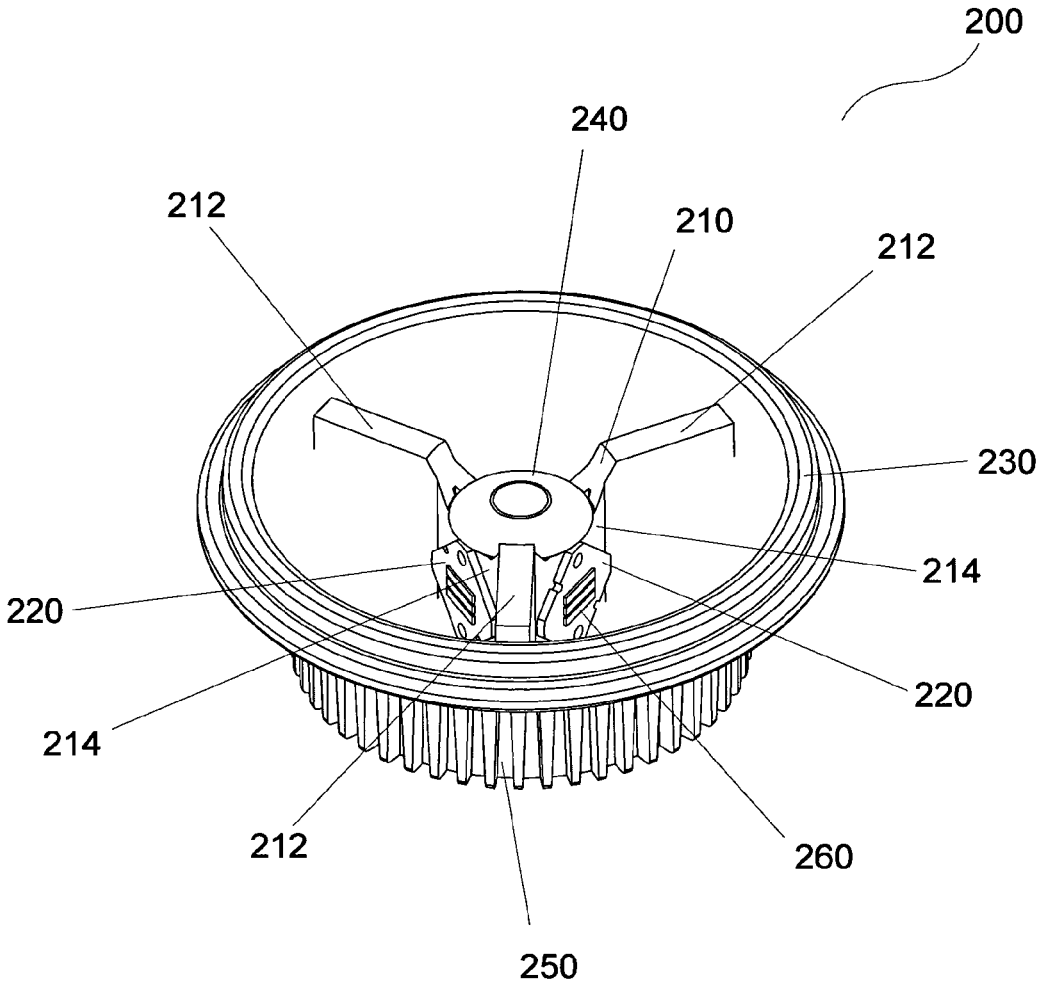
FIG. 7 is a perspective top view of a LED reflector lamp having three light source panels constructed in accordance with a second embodiment of the invention.

FIG. 7 illustrates a LED reflector lamp 200 constructed consistent with a second preferred embodiment of the present invention. The LED reflector lamp of this embodiment is structurally same as the one shown in the first embodiment above, except the following:

the LED reflector lamp has three light source panels 220 and three LED light sources 260, each of the LED light sources 260 is secured on the respective light source panel 220;

the heat-conducting plate 210 is triangular and comprises a central post defined by three side planar surfaces 214, and three heat-conducting branching plates 212 extending from the central post, and the three light source panels 220 are respectively secured on the three side planar surfaces 214 partitioned by the branching plates 212; and the metal cap 240 has correspondingly three notches for snap-connection with joints of the three side planar surfaces 214.

The heat sink 250 of the second embodiment is substantially same in structure as the heat sink 50 of the first embodiment. A higher power LED reflector lamp can be manufactured because of the addition of one more LED light source.

Figure 8:
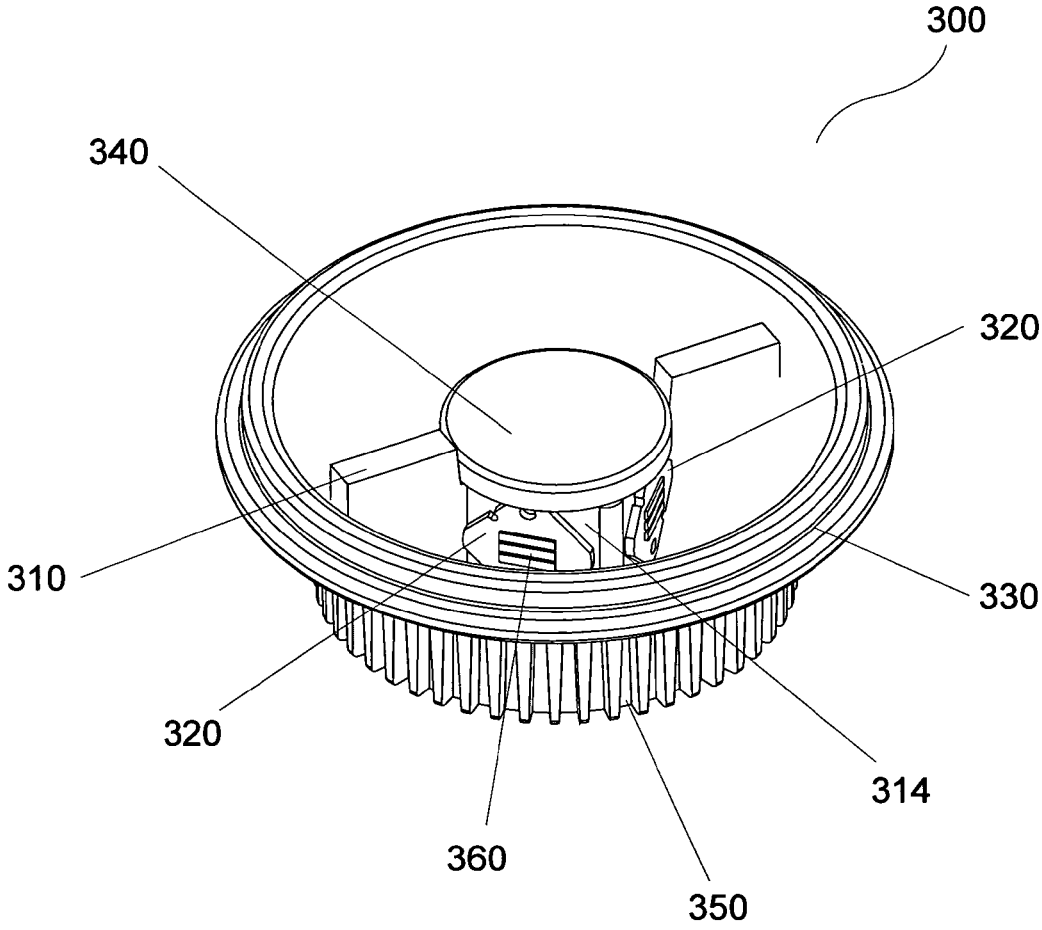
FIG. 8 is a perspective top view of a LED reflector lamp having four light source panels constructed in accordance with a third embodiment of the invention.

FIG. 8 illustrates a LED reflector lamp 300 constructed consistent with a third preferred embodiment of the present invention. The LED reflector lamp of this embodiment is structurally same as the one shown in the first embodiment above, except the following:

the LED reflector lamp has four light source panels 320 and four LED light sources 360, each of the LED light sources 360 is secured on the respective light source panel 320;

the heat-conducting plate 310 comprises a central post of quadrangular configuration defined by four side planar surfaces 314, and the four light source panels 320 are secured on the four side planar surfaces 314, respectively; and the metal cap 340 has correspondingly four notches for snap-connection with joints of the four side planar surfaces 314.

A much higher power LED reflector lamp is possible because of the addition of one more LED light source when compared to the LED reflector lamp 200 of the second embodiment.

FIGS. 9 to 12 illustrate a LED reflector lamp 400 constructed consistent with a fourth preferred embodiment of the present invention. The LED reflector lamp of this embodiment is substantially structurally same as the one shown in the first embodiment above and comprises two LED light sources 460, two light source panels 420, a heat-conducting plate 410, a heat sink 450 and a control circuit for controlling the LED light sources.

Figure 9:
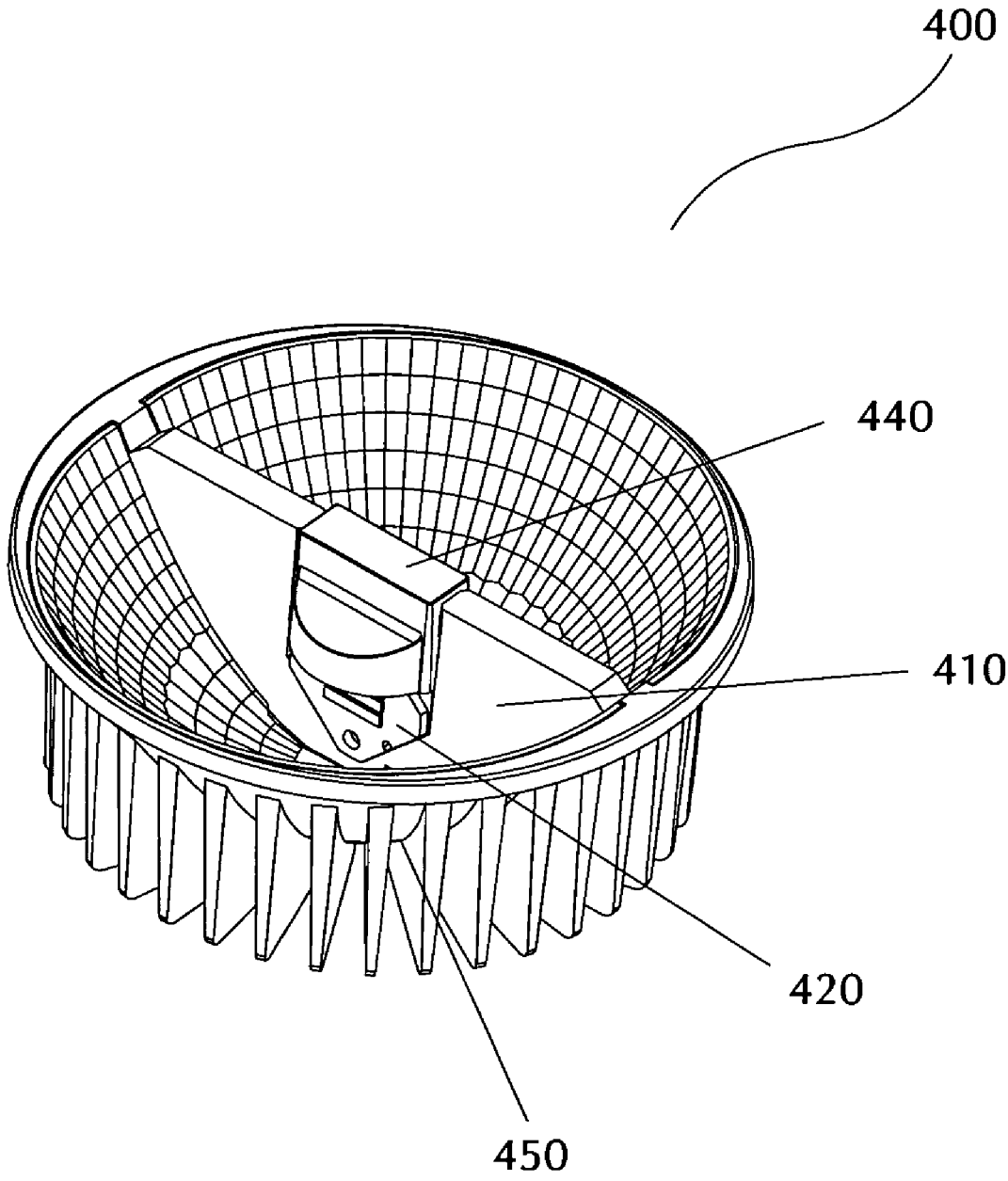
FIG. 9 is a perspective top view of a LED reflector lamp constructed in accordance with a fourth embodiment of the invention, wherein the LED reflector lamp has a reflective cup consisting of two symmetrical halves.
Figure 10:
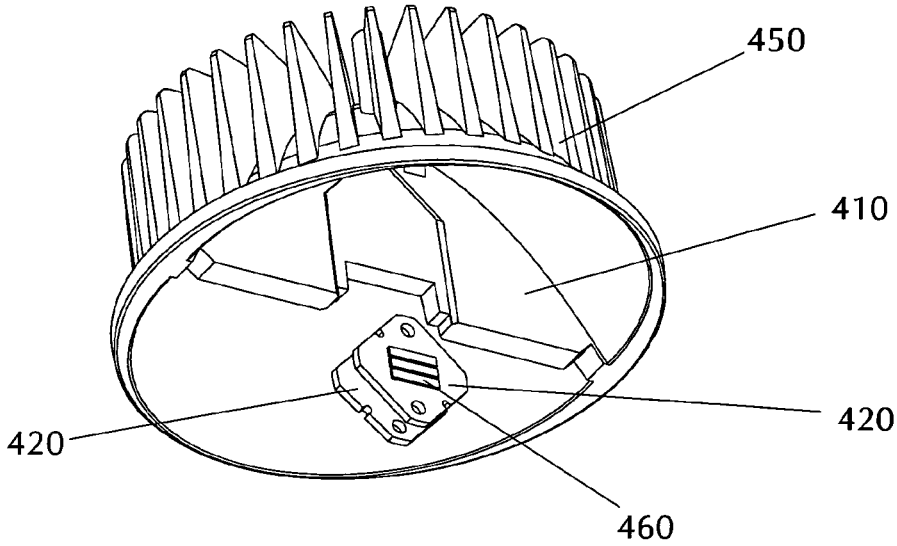
FIG. 10 is a perspective bottom view of the LED reflector lamp of FIG. 9.
Figure 10:
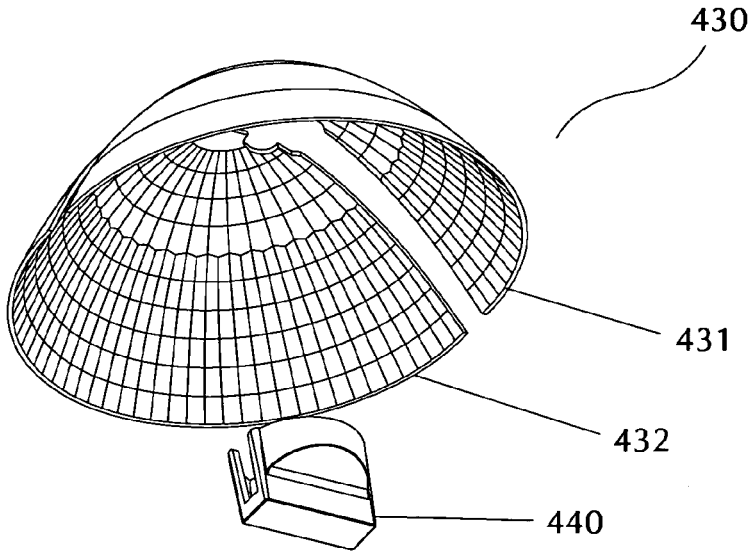
Figure 11:
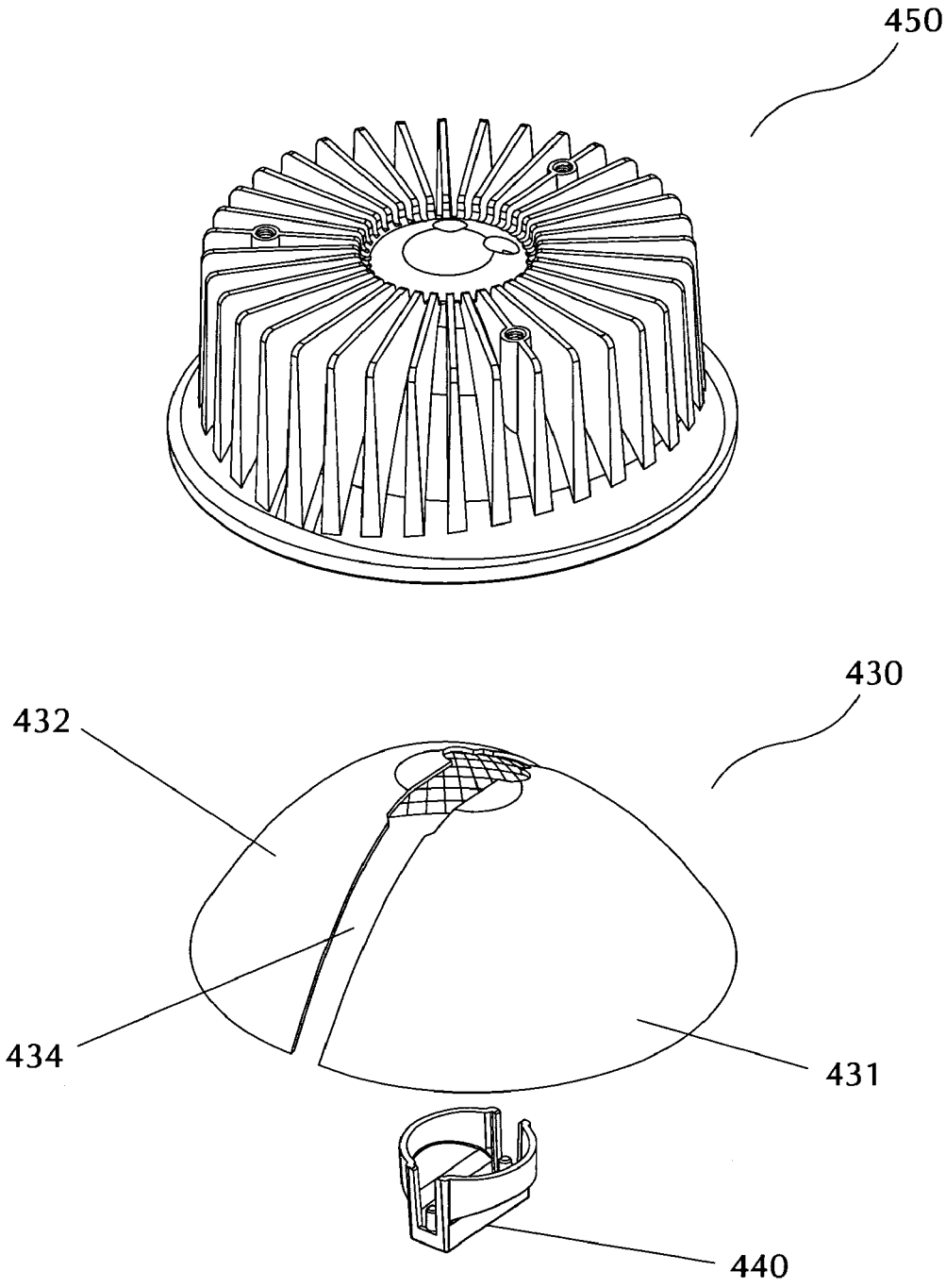
FIG. 11 is a perspective top view of the LED reflector lamp of FIG. 9.
Figure 12:
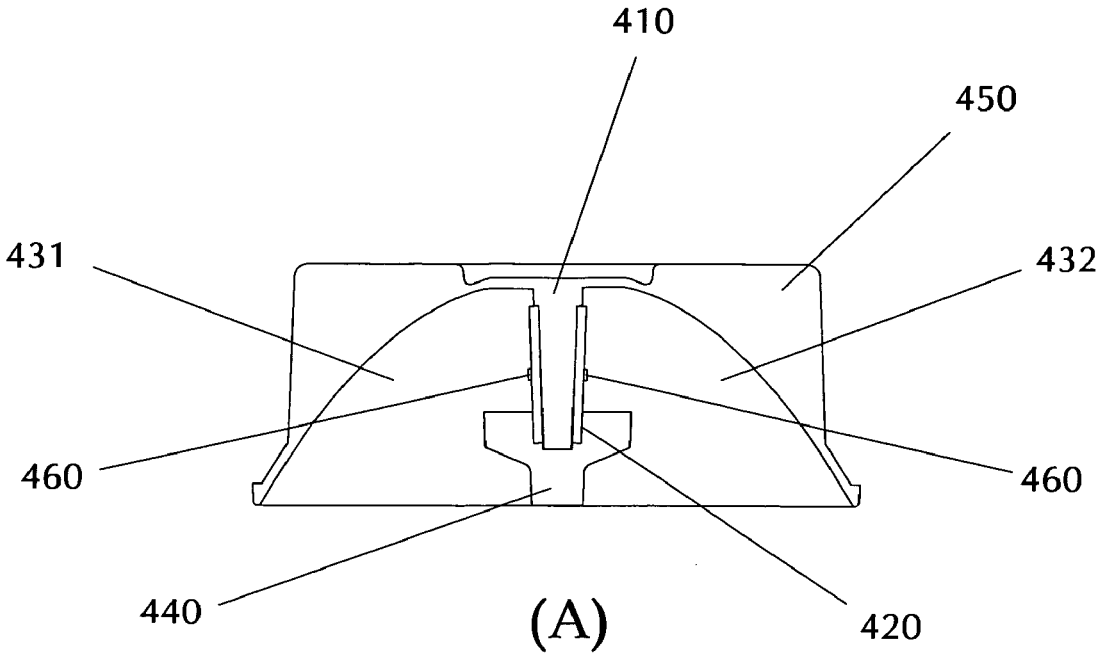
FIGS. 12(A) and 12(B) are sectional views of the centrally vertical axis of the LED reflector lamp of FIG. 9.
Figure 12:
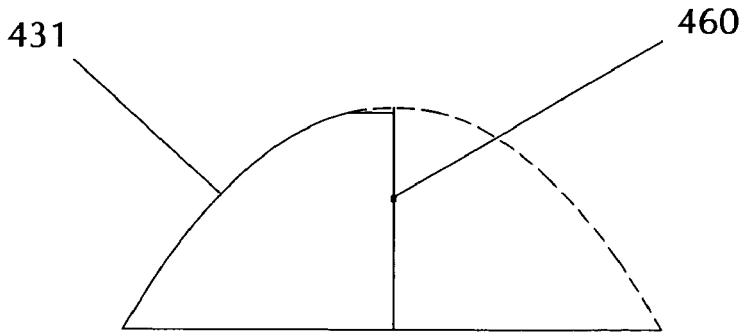

The LED reflector lamp 400 differs from the one of the first embodiment in that the reflective cup 430 consists of two symmetrical halves 431, 432 of same configuration and same dimension. The halves 431, 432 are assembled together to form a horn. These halves are symmetrically disposed relative to the centrally vertical axis of the reflective cup with a slot 434 formed. The slot 434 is sized and shaped such that the heat-conducting plate 410 secured with the LED light sources 460 and the light source panels 420 can be inserted through the slot 434 into the interior of the reflective cup 430, as shown in FIG. 9.

The LED reflector lamp 400 is characterized in that the two halves 431, 432 have their respective reflective inner surfaces which are parabolic surfaces formed by extension of parabolas, and that centers of the two LED light sources 460 are located at foci of the inner parabolic surfaces, respectively. In other words, the foci of the parabolas of the two halves 431, 432 overlap the centers of the two LED light sources 460, as shown in FIGS. 12(A) and 12(B). Such a configuration makes it possible that all the lights emitting from the LEDs are reflected by the inner parabolic surfaces of the two symmetrical halves 431, 432 to give out a better light condensation and obtain an enhanced luminous efficiency. It has been found that the luminous flux of the LED reflector lamp of this embodiment is increased by about 5% to 20% with respect to the existing LED lamps in the prior art.

The reflective inner surfaces of the symmetrical halves 431, 432 are smooth and can be coated with light reflecting materials to further enhance the luminous efficiency. It would be understood that the reflective inner surfaces of the halves 431, 432 can be of any surfaces of suitable configuration that are able to condense lights, which is within the ability of a person skilled in the art.

According to the invention, the light source panels secured with the LED light sources lie tightly against the heat-conducting plate which is connected to the heat sink in a thermally conductive manner, thereby creating a path having good characteristic of thermal conduction and thermal dissipation along the light source panels—the heat-conducting plate—the heat sink. The heat energy generated by the LED light sources is allowed to be dissipated rapidly through this path, which facilitates the reduction in the temperature of the LED light sources. Thus, the problem associated with the thermal dissipation of the LED lighting fixtures is successfully resolved. Moreover, the opening of the reflective cup without the arrangement of the lampshade helps improve the thermal dissipation. The lights emitting from the LED light sources can be reflected outward through the reflective inner surface of the reflective cup to condense the lights, because the LED light sources are mounted on the center of the reflective cup in a manner that the LED light sources are parallel to the centrally vertical axis of the reflective cup. When the centers of the LED light sources are designed to overlap the foci of the parabolas of the reflective cup, the LED reflector lamp of the invention would produce a better light condensation and a higher luminous flux. In addition, the alteration in the structure of the heat-conducting plate can increase the numbers of the LED light sources and the light source panels, allowing the manufacturing of a series of high power LED reflector lamps.

In case that the LED light sources are in the vicinity of the bottom of the reflective cup, the projection angle of the lights emitting from the LED light sources would be small; in case that the LED light sources are in the vicinity of the reflective opening of the reflective cup, the projection angle of the lights emitting from the LED light sources would be large. In this way, the projection angle of the LED reflector lamp can be adjusted to satisfy different applications. The number of the LED light sources may be 2 or above, for example, 3 or 4 and even more. Therefore, manufacturing a high power LED lamp is possible to find a wide range of occasions.

Thus, the present invention provides a LED reflector lamp which effectively solves the problem of thermal dissipation associated with high power LED lamps and which exhibits characteristics of high luminous efficiency and enhanced thermal dissipation.

Having sufficiently described the nature of the present invention according to some preferred embodiments, the invention, however, should not be limited to the structures and functions of the embodiments and drawings. It is stated that insofar as its basic principle is not altered, changed or modified it may be subjected to variations of detail. Numerous variations and modifications that are easily obtainable by means of the skilled person's common knowledge without departing from the scope of the invention should fall into the scope of this invention.

What is claimed is:

1. A LED reflector lamp, comprising a control circuit, characterized in that the LED reflector further comprises:

at least two LED light sources which are controlled by the control circuit;

at least two light source panels on which the at least two LED light sources are secured, respectively;

at least one heat-conducting plate on which the at least two light source panels are secured in a thermally conductive manner;

a reflective cup having a reflective inner surface, a reflective opening formed by a edge of the reflective inner surface, and a slot formed on a bottom of the reflective cup, wherein the heat-conducting plate secured with the LED light sources and the light source panels are inserted through the slot into an interior of the reflective cup such that the LED light sources are parallel to a centrally vertical axis of the reflective cup; and a heat sink having a cavity in its interior, the cavity being dimensioned and shaped to be coupled to at least a part of the reflective cup and the heat-conducting plate.

2. A LED reflector lamp according to claim 1, characterized in that the LED reflector lamp comprises:

two LED light sources;

two light source panels on which the two LED light sources are secured, respectively;

one heat-conducting plate, on each side of which the two light source panels are secured, respectively;

wherein the heat sink is of annular configuration and has a reflective inner surface that lies tightly against an outer surface of the reflective cup.

3. A LED reflector lamp according to claim 1, characterized in that the LED reflector lamp further comprises a metal cap disposed at the centrally vertical axis of the reflective cup, and the metal cap has two opposite sides, on each of which sides is formed a notch of same thickness of the heat-conducting plate, into which notches the heat-conducting plate is snapped snugly.

4. A LED reflector lamp according to claim 1, characterized in that the reflective cup consists of two symmetrical halves disposed symmetrically relative to the centrally vertical axis, each of the two halves has a reflective inner parabolic surface formed by extension of parabolas, wherein centers of the LED light sources are located at foci of the parabolas of the inner parabolic surfaces, respectively.

5. A LED reflector lamp according to claim 1, characterized in that the LED light sources are secured on the light source panels by glue dispensing or mechanically.

6. A LED reflector lamp according to claim 1, characterized in that the light source panels are secured on the heat-conducting plate by fasteners, glue dispensing or viscous radiating oils.

7. A LED reflector lamp according to claim 1, characterized in that a layer of radiating oil is arranged between the light source panels and the heat-conducting plate.

8. A LED reflector lamp according to claim 1, characterized in that the reflective cup is substantially horn-shaped.

9. A LED reflector lamp according to claim 1, characterized in that the reflective inner surface of the reflective cup is coated with light reflecting materials.

10. A LED reflector lamp according to claim 1, characterized in that the heat sink is a hollow cylinder, and the inner surface is of an arched configuration that mates with an outer surface of the reflective cup such that the inner surface of the heat sink lies tightly against the outer surface of the reflective cup.

11. A LED reflector lamp according to claim 1, characterized in that the heat sink has at its outer surface a plurality of radiating fins that are parallel to the centrally vertical axis of the reflective cup and disposed in a spaced manner.

12. A LED reflector lamp according to claim 1, characterized in that the heat sink has at its one end a plurality of ribs that extend from a center of the end of the heat sink to side walls of the heat sink.

13. A LED reflector lamp according to claim 1, characterized in that the LED light sources are arranged to get close to the bottom of the reflective cup.

14. A LED reflector lamp according to claim 1, characterized in that the LED light sources are arranged to get close to the reflective opening of the reflective cup.

15. A LED reflector lamp according to claim 1, characterized in that the heat-conducting plate is arranged such that a centrally vertical axis of the heat-conducting plate overlaps the centrally vertical axis of the reflective cup, and that a tangent line of a joint defined by the centrally vertical axis of the heat-conducting plate and arc lines of the reflective cup is vertical to the centrally vertical axis of the heat-conducting plate.

16. A LED reflector lamp according to claim 1, characterized in that the heat-conducting plate is made integral with the heat sink.

17. A LED reflector lamp according to claim 1, characterized in that the heat-conducting plate is made integral with the reflective cup.

18. A LED reflector lamp according to claim 1, characterized in that the heat sink is made integral with the reflective cup.

19. A LED reflector lamp according to of claim 1, characterized in that the heat-conducting plate is made integral with the heat sink and the reflective cup.

20. A LED reflector lamp according to claim 1, characterized in that the light source panels, the heat-conducting plate, the heat sink and the reflective cup are formed with a thermally conductive material.

21. A LED reflector lamp according to claim 20, characterized in that the thermally conductive material is selected from the group consisting of aluminium, aluminium alloy and ceramic.

22. A LED reflector lamp according to claim 1, characterized in that the opening of the reflective cup is provided with a lampshade.

* * * * *